US008882641B2

(12) United States Patent
Cutler et al.

(10) Patent No.: US 8,882,641 B2
(45) Date of Patent: Nov. 11, 2014

(54) EXERCISE APPARATUS AND METHOD OF USING

(76) Inventors: Elizabeth P. Cutler, New York, NY (US); Julie J. Rice, New York, NY (US)

( * ) Notice: Subject to any disclaimer, the term of this patent is extended or adjusted under 35 U.S.C. 154(b) by 519 days.

(21) Appl. No.: 13/005,595

(22) Filed: Jan. 13, 2011

(65) Prior Publication Data

US 2011/0172064 A1 Jul. 14, 2011

Related U.S. Application Data

(60) Provisional application No. 61/294,807, filed on Jan. 13, 2010.

(51) Int. Cl.

| | |
|---|---|
| ***A63B 21/00*** | (2006.01) |
| ***A63B 21/055*** | (2006.01) |
| ***A63B 22/06*** | (2006.01) |
| *A63B 21/22* | (2006.01) |
| *A63B 21/04* | (2006.01) |
| *A63B 22/00* | (2006.01) |

(52) U.S. Cl.

CPC ..... *A63B 21/0552* (2013.01); *A63B 21/225* (2013.01); *A63B 21/0442* (2013.01); *A63B 2209/10* (2013.01); *A63B 22/0012* (2013.01); *A63B 22/0605* (2013.01); *A63B 21/0555* (2013.01)

USPC ..... 482/83; 35/148; 35/87; 35/90

(58) Field of Classification Search

USPC ..... 482/57, 121, 69, 87

See application file for complete search history.

(56) References Cited

U.S. PATENT DOCUMENTS

| | | | | |
|---|---|---|---|---|
| 6,530,867 | B2 * | 3/2003 | Schwendemann | 482/83 |
| 7,766,803 | B2 * | 8/2010 | Carter | 482/102 |
| 2006/0019804 | A1 * | 1/2006 | Young | 482/93 |
| 2009/0156372 | A1 * | 6/2009 | Solomon | 482/69 |

* cited by examiner

*Primary Examiner* — Jerome W Donnelly

(74) *Attorney, Agent, or Firm* — Hogan Lovells US LLP

(57) ABSTRACT

An exercise apparatus and method of use for a total body workout. The exercise apparatus includes at least one stationary exercise equipment directed for lower body exercise, and at least one resistance device for upper body exercise deployed over the at least one stationary exercise equipment. Also included is a system adapted for providing a total body workout for an indoor cycling class that includes a plurality of stationary indoor cycling bikes and a plurality of resistance bands, one set of resistance bands deployed over each of the plurality of stationary indoor cycling bikes. The system enables users of the plurality of stationary indoor cycling bikes and resistance devices to simultaneously exercise the upper and lower body.

9 Claims, 7 Drawing Sheets

EXERCISE APPARATUS AND METHOD OF USING

RELATED APPLICATION

The present application claims benefit of priority of U.S. Provisional Patent application Ser. No. 61/294,807, filed Jan. 13, 2010, entitled Exercise Apparatus and Method of Using. The above-identified provisional application is incorporated herein by reference.

FIELD OF THE INVENTION

The present invention relates to exercise apparatus and, more particularly, to exercise apparatus providing a total body workout.

BACKGROUND OF THE INVENTION

Indoor cycling exercise is often conducted on a stationary bicycle, which can provide an intense cardio and lower body work out for a user. It can be a great form of aerobic exercise burning significant amount of calories in a short period of time. Indoor cycling is also beneficial in strengthening the muscles of the lower body, toning the quadriceps and hamstrings, along with working the back and hips.

Group exercises of indoor cycling can be carried out in a class format in a studio with an instructor leading the participant of the group exercise through a sequence of positions and movements. The stationary bicycles used in such classes are usually specialized bikes. Typically the bikes have a weighted flywheel that simulates the effects of inertia and momentum when riding a real bicycle. Additionally, the bikes may include a mechanical device to modify the resistance of pedaling, specially-shaped handlebars, and multiple adjustment points to fit the bicycle to a range of riders. The pedals may be equipped with toe clips as on racing bicycles, to allow one foot to pull up when the other is pushing down. The pedals may alternatively have clipless receptacles for use with cleated cycling shoes.

Stationary bicycles are designed to exercise the lower body of a user. The bikes used in indoor cycling exercises are therefore limited to exercising the lower body, particularly the legs of a participant. Upper body exercise during an indoor cycling routine has been limited to shifting positions on the handle bar of the stationary bike, to push-ups on the handle bar, or to the use of light free weights while cycling.

However, upper body exercise utilizes different muscle groups and increases heart rate and energy expenditure to a greater degree than lower body exercise. Total body workout by exercising both the upper and lower body produces the best overall results. Work is spread over a large muscle mass. Traditional stationary exercise equipment, with features such as levers, rowing type motions, or hand cranks, for upper body exercises are not suitable for the typical bikes used in indoor cycling classes. There exists a need for an exercise apparatus that combines the intense aerobic and lower body work out involving equipment used with stationary exercise, such as indoor cycling, with resistance training for the upper body, and to allow additional creative movements to a lower body workout on stationary equipment, such as an indoor cycling exercise routine.

SUMMARY OF THE INVENTION

The present invention provides an exercise apparatus to achieve a total (i.e., upper and lower) body workout, when such might not otherwise be available, and includes at least one stationary exercise equipment for lower body exercise, and at least one resistance device, such as a resistance band, for upper body exercise. The at least one resistance device can be generally deployed over the at least one stationary exercise equipment. Using the present invention, a participant can exercise on the at least one stationary exercise equipment while simultaneously using the at least one resistance device to receive a combined upper and lower body workout.

The at least one stationary exercise equipment can be a stationary exercise bike suitable for indoor cycling, perhaps including a weighted fly wheel. However, any stationary exercise equipment that focuses on the aerobic and/or anaerobic exercise of the lower body may be used (e.g., leg press, leg extension and/or leg curl machine; or a stair/step machine, elliptical, treadmill device). The resistance device can comprise a spring material, elastomeric material, or another material used for resistance exercises, where the resistance device can take the form of one or more elongated bands, ropes, tubes, or some form of elastic, spring, or resistance providing material or device of suitable shape and form.

In one aspect of the invention, the at least one resistance device can be fixed (e.g., directly fixedly connected) to a location over the at least one stationary exercise equipment, or can be movably deployed (e.g., along a track) over the at least one stationary exercise equipment. Thereby, for example, the invention could further include at least one track positioned over the at least one stationary exercise equipment, and at least one roller carriage movable on or within the at least one track. The roller carriage could include one or more rollers allowing travel of the roller carriage along the track, for quick and temporary positioning over a stationary exercise equipment, and an attachment mechanism (e.g., eye bolt with snap clip) providing connection of the at least one resistance device to the roller carriage.

Another aspect of the invention has the at least one roller carriage including a frame, perhaps generally rectangular, one, two or more rollers aligned longitudinally within or about the frame, with at least one resistance device in communication with each roller carriage. The roller carriage could have attached thereto a loop or hook (e.g., affixed to the frame) for attaching the at least one resistance device to the roller carriage. The roller carriage could further include screws, clamps or other device for attachment of the carriage to the track. Other aspects of the invention could include a track or roller carriage of varying shape (e.g., a round or triangular track in cross-section, with a roller carriage of ball-bearings type devices).

In a further aspect of the invention, at least one locking mechanism secures the at least one roller carriage on and/or to the at least one track over the at least one stationary exercise equipment. The at least one locking mechanism could include at least one tab, or spring loaded tab, extending from the rectangular frame, where the extended tab is positioned beneath at least one roller when the roller carriage abuts the locking mechanism on the track. The locking mechanism could also include one or more set screws for fixing the locking mechanism to the track and to the at least one spring loaded tab.

Also included in the present invention is a method for exercising and receiving a combined upper and lower body workout, the method implementing an exercise apparatus including stationary exercise equipment and at least one resistance device deployed over the stationary exercise equipment. The exercise method involves exercising the lower body on the stationary exercise equipment and exercising the upper body using the at least one resistance device. In typical use, multiple stationary exercise equipment and multiple sets of one or more resistance devices would be aligned in an exercise facility for individual or class-type workouts, with each set of resistance device(s) deployed above a respective stationary exercise equipment.

BRIEF DESCRIPTION OF THE DRAWINGS

The present invention will be better understood with reference to the following description taken in combination with the drawings. For the purpose of illustration, there are shown in the drawings certain embodiments of the present invention. It should be understood, however, that the invention is not limited to the precise arrangements, dimensions, and instruments shown. In the drawings.

DETAILED DESCRIPTION OF THE ILLUSTRATED EMBODIMENTS

Indoor cycling is traditionally limited to a lower body aerobic workout because of the limitation of the stationary exercise equipment. The present invention presents a novel method and apparatus that deploys a resistance device over the stationary exercise equipment, enabling the user of the stationary exercise equipment to simultaneously receive an upper and lower body workout.

As used herein, the term resistance device is used broadly to refer to a spring material, an elastomeric material, or another material used for resistance exercises, where the resistance device can take the form of one or more elongated bands, ropes, tubes, or some form of elastic, spring, or resistance providing material or device of suitable shape and form. Resistance devices can be color coded to indicate the strength of (or level of resistance provided by) each of the individual resistance devices. The term stationary exercise equipment preferably refers to stationary bikes used for indoor cycling exercise. However, any stationary exercise equipment that focuses on the aerobic or anaerobic exercise of the lower body may be used with the overhead resistance device system of the present invention.

In one embodiment of the present invention, one or more resistance devices are fixed or attached above each of a plurality of stationary exercise equipment. The resistance devices could be fixed to a ceiling, or to a structural or spanning member located anywhere above the plurality of stationary exercise equipment. One example is to affix a respective anchor to the ceiling directly above each piece of stationary exercise equipment (i.e., each piece of stationary exercise equipment would have one anchor directly above). Alternatively, more than one anchor could be used for each piece of stationary exercise equipment. One or more resistance devices can be attached to each of the anchors.

Figure 1A:
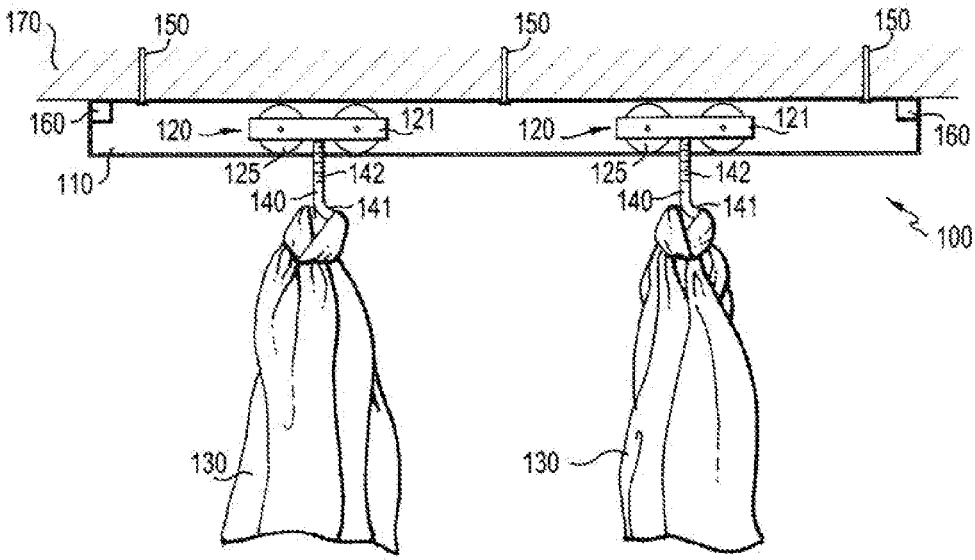
FIG. 1A illustrates one embodiment of the present invention, showing one implementation (a roller carriage implementation) of the resistance device distribution system.
Figure 1B:
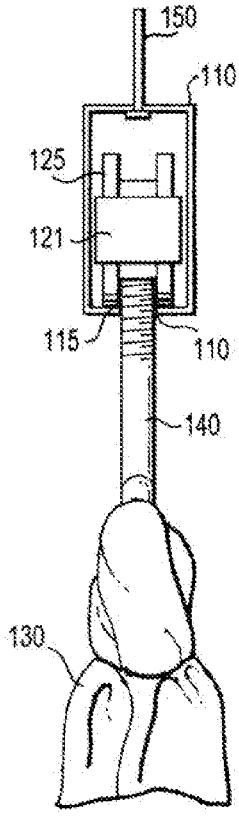
FIG. 1B illustrates an end view of the embodiment of the present invention as shown in FIG. 1A.

FIGS. 1A and 1B illustrate one exemplary embodiment of the present invention 100. In this particular embodiment, tracks 110 are affixed over a plurality of stationary exercise equipment. Roller carriages 120 comprising a frame 121, one or more rollers or wheels 125, and an attachment mechanism 140 for the resistance device (in this example, resistance bands) 130 are deployed along or within the tracks 110. The roller carriages 120 glide along or within the tracks 110 allowing easy adjustment of the positioning of the roller carriages 120 in relation to the stationary exercise equipment below. In the FIGS. 1A and 1B embodiment, the roller carriages 120 are simply pulled along the track 110, each to a desired position for use, and then retracted back to an end of the track after use. End stops 160 are shown at track ends to prevent the roller carriages 120 from leaving the track 110. In this arrangement, the roller carriages 120 are simply aligned and stored at the end of the track 110 after use. If so desired, the end stops 160 could be removed, and the roller carriages 120 could be removed from the track 110 after use.

The attachment mechanism 140 of the roller carriage, in the FIGS. 1A and 1B embodiment, is an eye bolt 141 comprising a loop or hook for the attachment of the resistance device (e.g., bands) 130 to the roller carriage 120, and a stem 142 that connects the loop or hook of the eye bolt 141 to the frame 121 of the roller carriage 120. The stem 142 may be bolted, screwed, riveted, or welded to the frame 121 of the roller carriage 120. The tracks 110 of the present invention may be anchored 150 to the ceiling 170, above the stationary exercise equipment. In the FIGS. 1 A and 1B embodiment, the track 110 is a C-shaped channel having a downward facing center slot. The wheels 125 of the roller carriage 120 ride on the track surfaces 115 on either side of the center slot. The stem 142 of the eye bolt 141 extends through the center slot, wherein the loop or hook of the eye bolt 141 is located below the track 110. End stops 160 are placed at either end of each of the tracks 110, providing an end stop, to prevent the roller carriage 120 from coming off of, or exiting the end of, the track 110. Further, a spring-loaded D-style fastener (not shown), or similar snap clip, could be used to connect the loop of the eye bolt 141 to the resistance device 130, providing easy removal of the resistance device 130 from their ceiling hanging position. In this embodiment, the resistance device (s) 130 are attached (e.g., strapped) to the D-style fastener, and the fastener is conveniently snap-clipped to the eye bolt 141 of the attachment mechanism 140.

Figure 2:
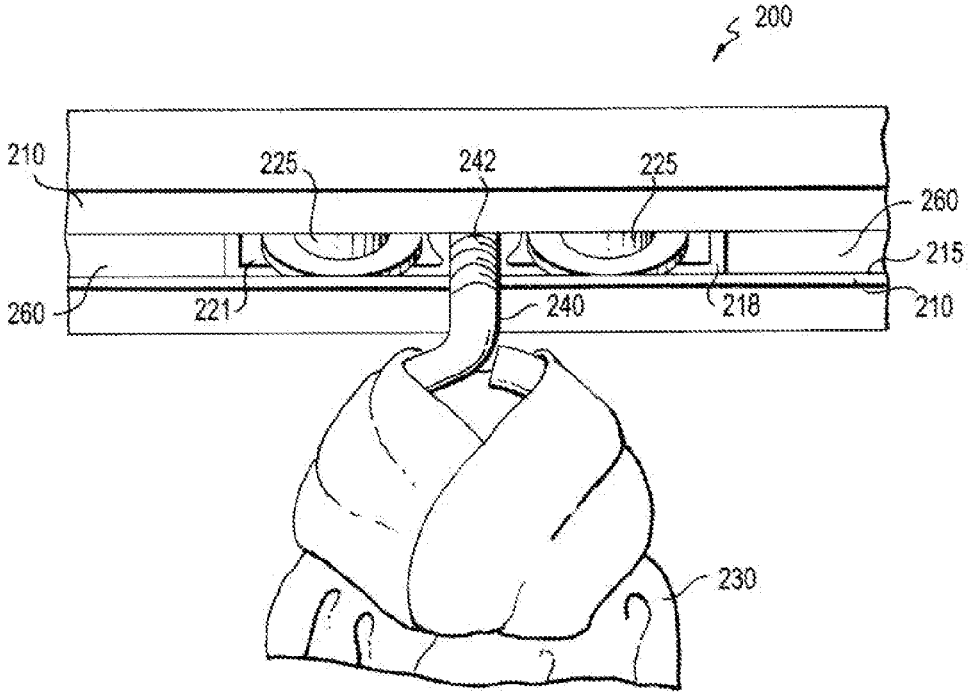
FIG. 2 is a bottom view of the embodiment shown in FIG. 1, showing one roller carriage mounted on a track.

FIG. 2 is a close-up, bottom view of another embodiment of the present invention 200. FIG. 2 is also included within FIG. 3. FIG. 2 illustrates one roller carriage 220 mounted on or within a track 210. The wheels 225 of the roller carriage 220 ride on the rim of the C-shaped track 210. The stem 242 of the attachment mechanism 240 is threaded and screwed into a correspondingly threaded hole in the frame 221 of the roller carriage 220. The attachment mechanism 240 could be connected to the frame 221 in a variety of ways known in the art.

Figure 3:
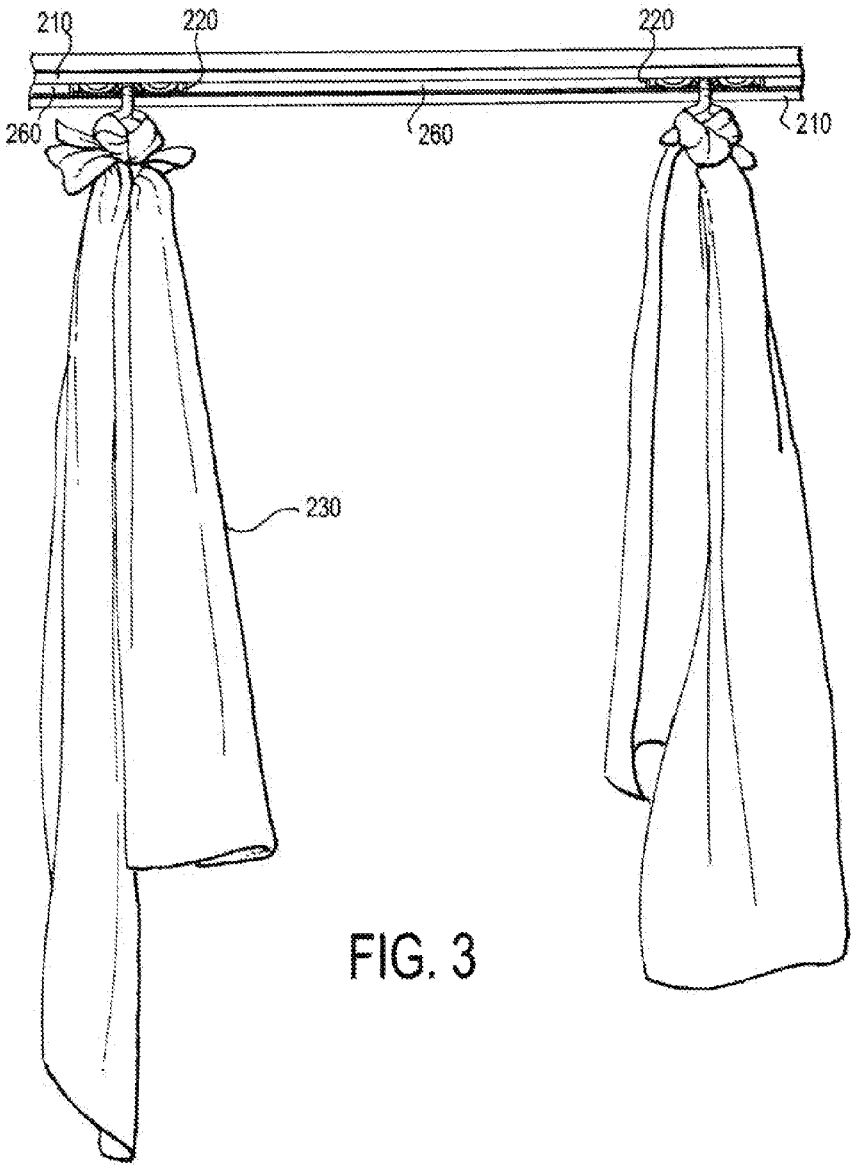
FIG. 3 is another bottom view of the embodiment shown in FIG. 1, showing an exemplary arrangement of a plurality of roller carriages mounted on a track.

FIG. 3 is another bottom view of the embodiment shown in FIG. 2, illustrating an exemplary arrangement of a plurality of roller carriages 220 on or within a track 210. In the embodiment of FIGS. 2 and 3, spacers 260 are inserted within the track 210, between respective roller carriages 220, to fix the relative position of the roller carriage 220 and resistance devices (in this example, resistance bands) 230 above a respective piece of stationary exercise equipment.

Figure 4:
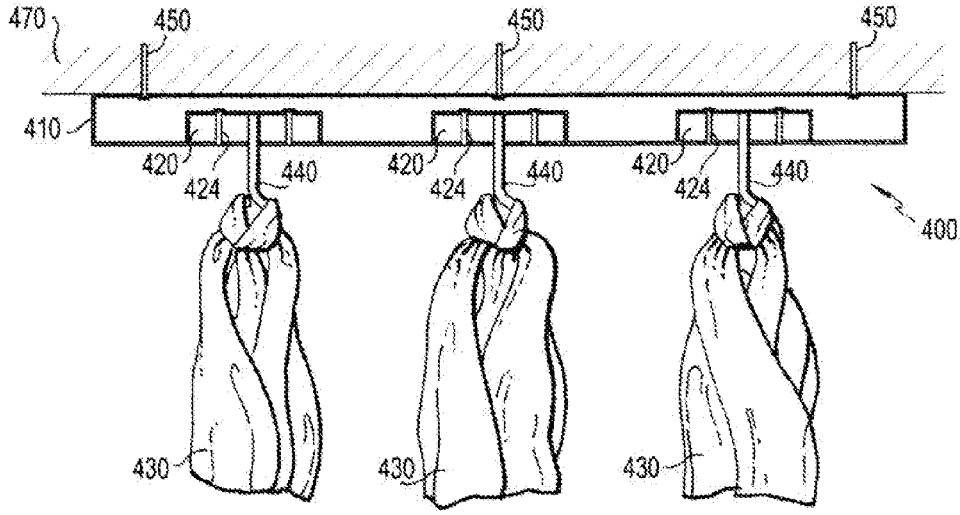
FIG. 4 illustrates another embodiment of the present invention, showing a fixed, or stationary carriage, implementation of the resistance device distribution system.

FIG. 4 illustrates another embodiment of the present invention 400, showing a fixed, or stationary carriage, implementation of the resistance device distribution system. In this embodiment, tracks 410 are similarly deployed over a plurality of stationary exercise equipment and anchored 450 to a ceiling 470 above. Stationary carriages 420 are fastened 424 to the tracks 410. Attachment mechanisms 440 (in this example, eye bolts) are used to attach the resistance devices 430 to the stationary carriages 420. Similarly, a spring-loaded D-style fastener could alternatively be employed in this embodiment, and in all embodiments shown herein. The D-style fastener or similar snap-clip would have the resistance devices 430 attached thereto, providing quick on-off attachment of the resistance devices 430 to the stationary carriages 420.

Figure 5:
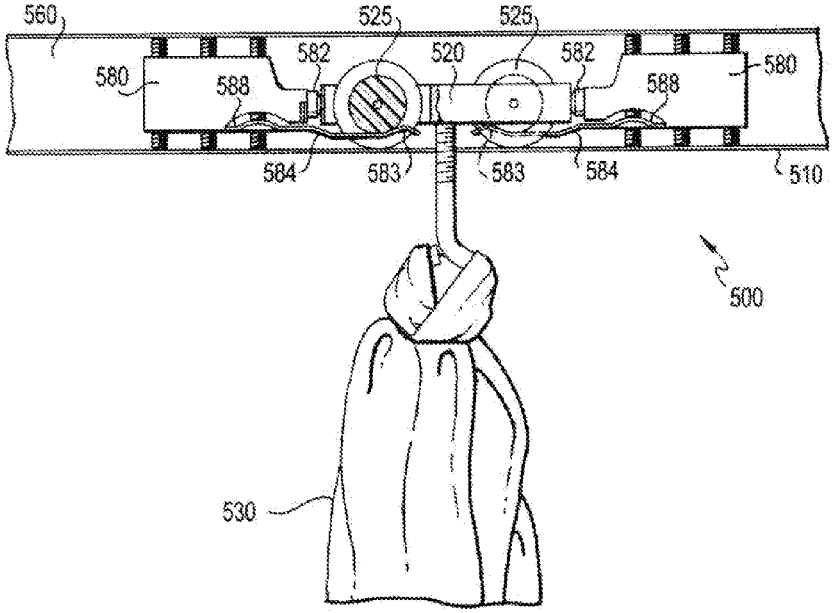
FIG. 5 illustrates yet another embodiment of the present invention, showing locking mechanisms used in association with the roller carriage implementation of the resistance device distribution system.

FIG. 5 illustrates yet another embodiment of the present invention 500, showing two locking mechanisms 580 used in association with the roller carriage 520 implementation of the resistance device distribution system. Tracks 510 and a roller carriage 520 similar to the embodiments of FIGS. 1-3 are deployed over a plurality of stationary exercise equipment. In this embodiment, C-channel tracks are used. In addition, two locking mechanisms 580 are used in conjunction with the roller carriage 520 to fix and secure the position of the roller carriage 520 along the tracks 510. Alternatively, one locking mechanism 580 could be used in conjunction with each roller carriage 520 to provide one-sided stabilization of the roller carriage 520 during use.

Figure 6:
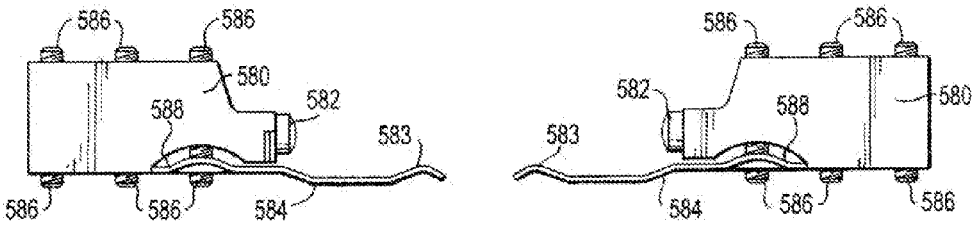
FIG. 6 is a side view of the locking mechanisms shown in FIG. 5.

In FIG. 5, two locking mechanisms 580 are used, each having a rubber stopper 582, a spring loaded metal tab 584 for roller engagement, and pins (in this case, screws) 586 for attachment of the locking mechanism 580 to the track 510, and attachment 588 of the spring loaded metal tab 584 to the locking mechanism 580. In use, at least one locking mechanism 580 (but preferably two) are attached to the track 510 with the respective spring loaded metal tab 584 extending under a roller 525 of the roller carriage 520. The metal tab 584 further comprises a free end that is bent upward 583 preventing the roller 525, under minimal force, from traveling away from the locking mechanism 580. The rubber stopper 582 can be deposited on the side of the locking mechanism 580 facing the roller carriage 520. In the FIG. 5 configuration, the roller carriage 520 is fixed in place along the track 510 using the locking mechanisms 580. FIG. 6 is a close-up, side view of locking mechanisms 580 of FIG. 5. It is understood that the various components of the locking mechanism 580 could be altered or substituted for varying degrees of functionality described.

Figure 7:
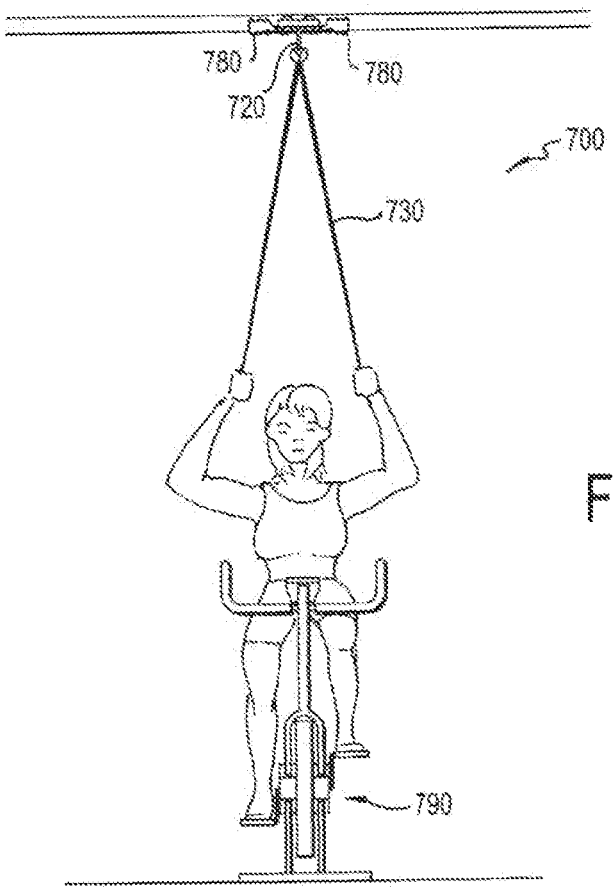
FIG. 7 is an elevation view of an exemplary arrangement of the resistance device distribution system shown in FIG. 5 relative to one piece of stationary exercise equipment.

FIG. 7 is an elevation view of an exemplary arrangement of the resistance device distribution system 700 shown in FIG. 5 relative to one piece of stationary exercise equipment 790 (in FIG. 7, a stationary bike). Two locking mechanisms 780 can be used to fix the position of the otherwise movable roller carriage 720 above a piece of stationary exercise equipment 790, thereby enabling a user of the stationary exercise equipment 790 to simultaneously access and use the resistance devices 730 deployed overhead.

Figure 8:
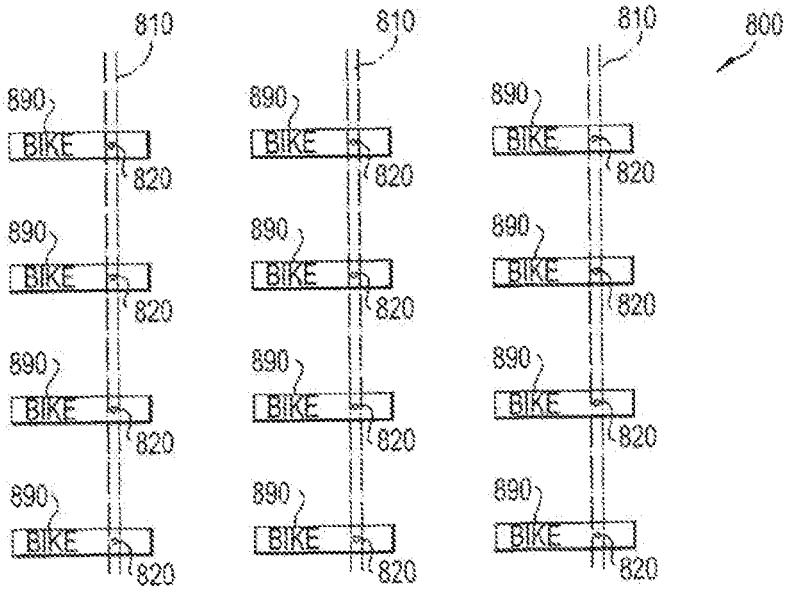
FIG. 8 is a top view of an exemplary arrangement of the resistance device distribution system as shown in FIG. 5 relative to a plurality of stationary exercise equipment.

FIG. 8 is a top view of an exemplary arrangement of the resistance device distribution system 800 as shown in FIG. 5 relative to a plurality of stationary exercise equipment 890. Tracks 810 are deployed over a row of stationary exercise equipment 890 (e.g., stationary bikes for indoor cycling exercise). In FIG. 8, the tracks 810 are deployed from side to side across a row of bikes. Alternatively, the tracks 810 could equally be deployed from front to back along a row of bikes 890. In one embodiment, roller carriages 820 with attached resistance devices are positioned, using locking mechanisms, directly above each piece of stationary exercise equipment 890. In another embodiment, the roller carriages 820 with attached resistance devices would not be locked in place within the track 810, but would rather be movably positioned above each piece of stationary exercise equipment 890. Again, in still another embodiment, the resistance devices could simply be directly fixedly connected above (e.g., to the ceiling) each piece of stationary exercise equipment 890.

In FIG. 8, a small circle indicates the precise, exemplary position of the roller carriage 820. It is preferred that the resistance devices are located above and slightly in front of a user using the stationary exercise equipment 890. This arrangement of the resistance device distribution system enables a plurality of users of the stationary exercise equipment 890 to simultaneously access the resistance devices deployed overhead. This arrangement of the plurality of resistance devices and stationary exercise equipment is particularly suitable for a class setting, such as an indoor cycling class.

Figure 9:
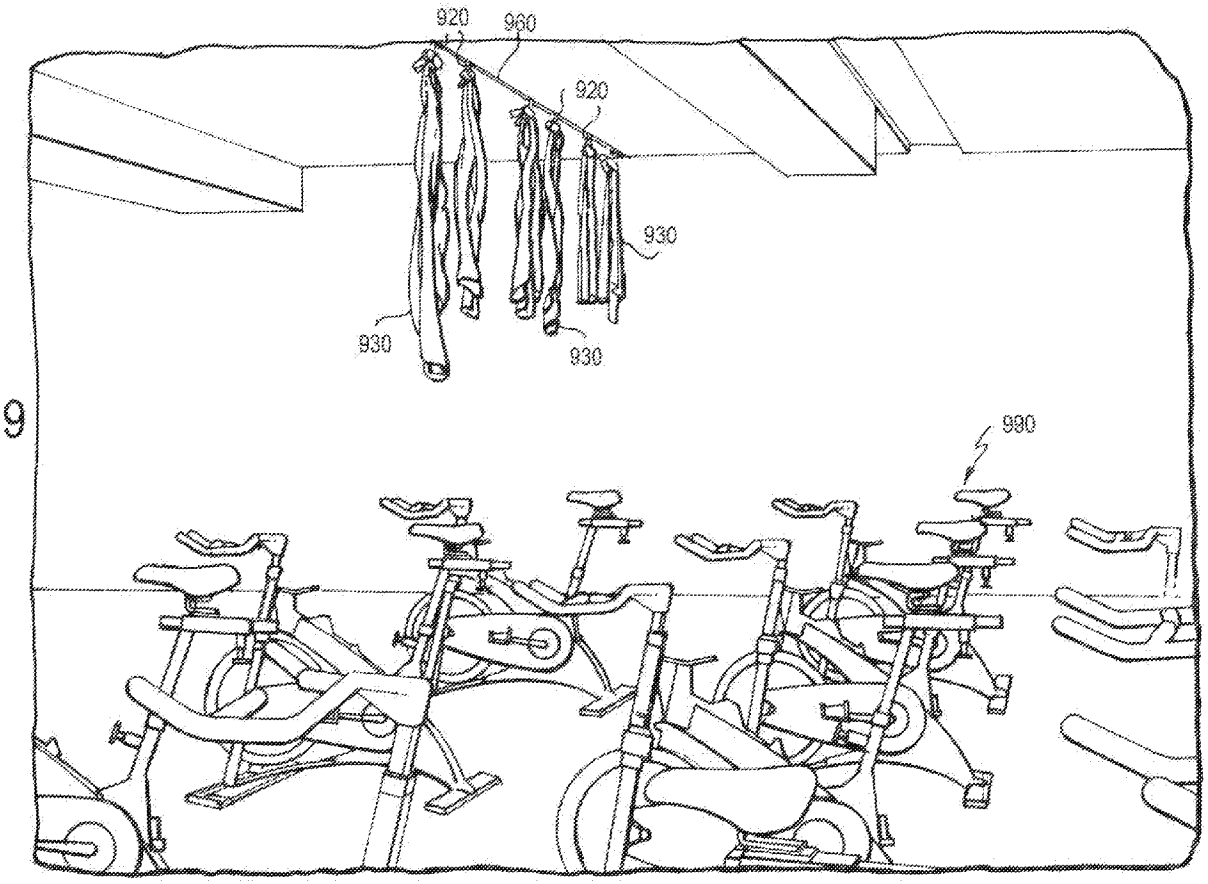
FIG. 9 is a perspective view of an exemplary arrangement of the resistance device distribution system as shown in FIG. 1 relative to a plurality of stationary exercise equipment.

FIG. 9 is a perspective view of an exemplary arrangement of the resistance device distribution system as shown in FIG. 8 in relation to a plurality of stationary exercise equipment 990. A track 910 is deployed over each row of stationary exercise equipment 990, from side to side across the respective row (in this embodiment, the stationary exercise equipment 990 are bicycles, but could be any form of stationary exercise equipment). In FIG. 9, roller carriages 920 are located along and within respective tracks 910 with spacers 960 deposited between respective roller carriages 920 to maintain separation of the roller carriages 920 and to maintain the relative position of the resistance devices 930 over their respective piece of stationary exercise equipment 990.

As mentioned, the present invention provides for the simultaneous use of upper body resistance device training (e.g., via one or more resistance bands, tubes, springs, etc.) and lower body stationary exercise equipment. The combination of an upper body resistance routine along with lower body aerobic or anaerobic exercise (e.g., a cycling sequence) provides participants with a total body workout. An exemplary exercise class could be 30, 60, or 90 minutes in total length, including a warm-up period, an upper body resistance sequence period, a lower body cycling period with various interval speed training, a combination upper body resistance and lower body cycling period, or any variation thereof, followed by a cool down period.

Upper body resistance sequence periods could be done with one or more resistance devices, and could be directed to a core (i.e., abdominal) workout, an upper body toning workout, or a combination of core and upper body toning workout. The core workout could include one or more of a basic crunch, an oblique crunch, or a count crunch. The upper body toning workout could include one or more of lat pull-downs, rows, pull-overs, bicep curls, tricep presses, or various combinations thereof.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. Specific dimensions of any particular embodiment are described for illustration purposes only. It should therefore be understood that this invention is not limited to the particular embodiments described herein, but is intended to include all changes and modifications that are within the scope and spirit of the invention.

What is claimed is:

1. An exercise apparatus for a total body workout, comprising:

at least one stationary exercise equipment, wherein the stationary exercise equipment is for lower body exercise; and at least one resistance device for upper body exercise deployed over the at least one stationary exercise equipment;

at least one track positioned over the at least one stationary exercise equipment;

at least one roller carriage movably attached to the at least one track, the at least one roller carriage comprising:

one or more rollers allowing travel of the roller carriage along the at least one track; and an attachment mechanism providing connection of the at least one resistance device to the roller carriage; and at least two locking mechanisms positioned on opposite sides of the one or more rollers to secure each of the at least one roller carriages on the at least one track over the at least one stationary exercise equipment;

whereby a user of the exercise apparatus can simultaneously exercise on the at least one stationary exercise equipment and use the at least one resistance device band.

2. The exercise apparatus of claim 1, wherein the at least one stationary exercise equipment is a stationary exercise bike.

3. The exercise apparatus of claim 2, wherein the at least one stationary exercise bike comprises a weighted fly wheel.

4. The exercise apparatus of claim 1, wherein the at least one roller carriage further comprises:

a frame;

two rollers aligned longitudinally within the frame; and a loop or hook affixed to the frame for attaching the at least one resistance device to the roller carriage.

5. The exercise apparatus of claim 1, wherein the at least two locking mechanisms each comprise:

at least one tab extending from a frame, wherein the extended tab is positioned beneath at least one roller when the roller carriage abuts the locking mechanism on the track; and one or more pins for fixing the locking mechanism to the track and to the at least one tab.

6. A exercise system adapted to provide an upper and lower body workout for an exercise class, the system comprising:

a plurality of stationary exercise equipment;

a plurality of resistance devices, each one respectively deployed over, and separated from, a respective one stationary exercise equipment, at least one track positioned over the plurality of stationary exercise equipment;

at least one roller carriage movably attached to the at least one track, the at least one roller carriage comprising:

one or more rollers allowing travel of the roller carriage along the at least one track; and an attachment mechanism providing connection of the at least one resistance device to the roller carriage; and at least two locking mechanisms positioned on opposite sides of the one or more rollers to secure each of the at least one roller carriages on the at least one track over the plurality of stationary exercise equipment;

whereby a plurality of users of the exercise system can each simultaneously exercise using a stationary exercise equipment and a resistance device, enabling the plurality of users of receiving a simultaneous upper and lower body workout.

7. The exercise system of claim 6, wherein the plurality of resistance devices are resistance bands.

8. The exercise system of claim 6, wherein the roller carriage further comprises:

a frame;

two rollers aligned longitudinally within the frame; and a loop or hook affixed to the frame for attaching a respective resistance band to the roller carriage.

9. The exercise system of claim 6, wherein the at least two locking mechanisms each comprise:

at least one tab extending from a frame, wherein the extended tab is positioned beneath at least one roller when the roller carriage abuts the locking mechanism on the track; and one or more set screws for fixing the locking mechanism to the track and to the at least one tab.

* * * * *